US007235728B2

(12) United States Patent
Schleske

(10) Patent No.: US 7,235,728 B2
(45) Date of Patent: Jun. 26, 2007

(54) SOUNDBOARD OF COMPOSITE FIBRE MATERIAL CONSTRUCTION FOR ACOUSTIC MUSICAL INSTRUMENTS

(76) Inventor: Martin Schleske, Grubmhl 22, Stockdorf (DE) 82131

( * ) Notice: Subject to any disclaimer, the term of this patent is extended or adjusted under 35 U.S.C. 154(b) by 0 days.

(21) Appl. No.: 11/195,470

(22) Filed: Aug. 2, 2005

(65) Prior Publication Data

US 2006/0042448 A1 Mar. 2, 2006

(30) Foreign Application Priority Data

Aug. 24, 2004 (DE) ..... 10 2004 041 011

(51) Int. Cl.
*G10D 3/00* (2006.01)

(52) U.S. Cl. ..... 84/291

(58) Field of Classification Search ..... 84/311, 84/290, 291, 267, 275
See application file for complete search history.

(56) References Cited

U.S. PATENT DOCUMENTS 4,353,862 A 10/1982 Kaman, II
6,051,764 A * 4/2000 Sakurai ..... 84/291
6,683,236 B2 * 1/2004 Davis et al. ..... 84/291

FOREIGN PATENT DOCUMENTS

| | | |
|---|---|---|
| DE | 2115119 | 10/1971 |
| EP | 1 182 642 A2 | 8/2001 |
| WO | WO91/00589 | 1/1999 |
| WO | WO 00/20360 | 4/2000 |

* cited by examiner

*Primary Examiner*—Kimberly Lockett
(74) *Attorney, Agent, or Firm*—John K. McCulloch

(57) ABSTRACT

The invention relates to a soundboard of composite fibre material construction for acoustic musical instruments, comprising at least three sheets which each extend over a substantial part of the entire surface of the soundboard, of which the two outer sheets each contain a layer of long fibres embedded in a carrier material and the middle sheet has a lower density than the two outer sheets. In this case the long fibres of the two outer sheets are disposed parallel to one another in the respective sheet and—relative to an imaginary vertical longitudinal central plane of the soundboard—extend at acute angles between 2 and 25°. In this way a markedly improve acoustic quality and simplified production are achieved.

13 Claims, 7 Drawing Sheets

Figure 1:
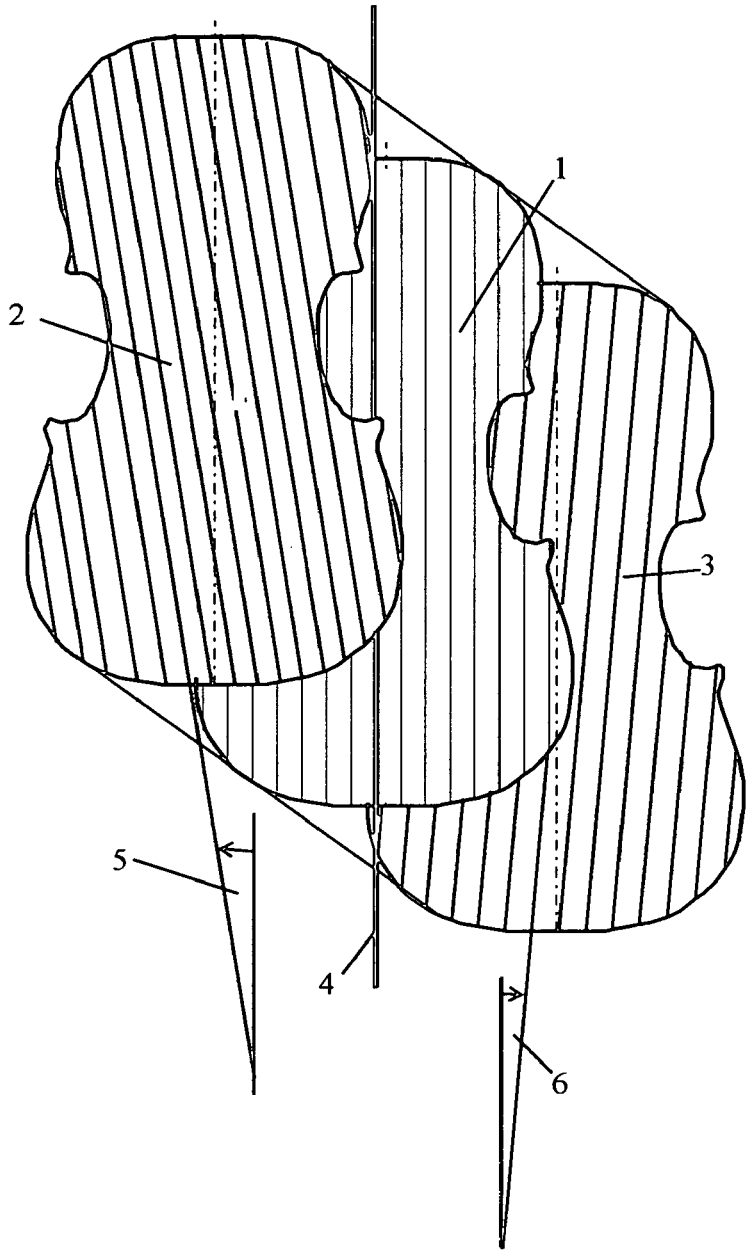

SOUNDBOARD OF COMPOSITE FIBRE MATERIAL CONSTRUCTION FOR ACOUSTIC MUSICAL INSTRUMENTS

The invention relates to a soundboard of composite fibre material construction for acoustic musical instruments, in particular for use as at least one of the two soundboards of the resonant body of bowed stringed instruments, comprising at least three sheets which each extend over a substantial part of the entire surface of the soundboard, of which the two outer sheets each contain a layer of long fibres embedded in a carrier material and the middle sheet has a lower density than the two outer sheets.

In recent years attempts have been made to produce the soundboards of acoustic musical instruments in composite fibre material construction. Structures of composite fibre material construction generally consist of long fibres which are oriented in specific directions and a carrier material which is generally a thermosetting or thermoplastic plastics material, in particular an epoxy resin system.

The previous efforts to produce soundboards of composite fibre material construction are aimed without exception at copying as well as possible the acoustic characteristics of the wood which is to be substituted. Thus U.S. Pat. No. 4,353,862 A shows a guitar soundboard in which a fibreglass fabric impregnated with polyester resin is applied to a wood sheet. In this case the weft threads of the fibreglass fabric extend approximately parallel to the grain of the wood sheet and the warp threads of the fibreglass fabric extend approximately transversely with respect to the grain of the wood sheet.

EP 0 433 430 A relates to a soundboard of a bowed stringed instrument in which a plurality of sheets are disposed one above the other, each of which comprises long fibres which are embedded in a carrier material. In this case in each sheet the long fibres extend parallel to one another, whilst the fibre directions of the individual sheets differ from one another. The top and bottom cover sheet of this soundboard are made from wood in order to reduce the overall density of the soundboard and to achieve the desired damping properties.

The subject matter of EP 1 182 642 A1 is also a soundboard consisting of three sheets in which the middle sheet forms a core plate of lower density, whilst the two outer sheets have a fibre laminate comprising long fibres which are embedded in a carrier material. In this case the fibre laminate is of single-layer and at the same time multidirectional construction.

Finally, a soundboard is known from DE 21 15 119 B, the core of which is made from foam plastics material and is covered on its two sides by wooden reinforcing parts. The grain directions of these wooden reinforcing parts extend in the longitudinal or cross direction of the soundboard, that is to say they intersect at right angles.

The object of the invention, therefore, is to make further developments to a soundboard of the aforementioned type in such a way that on the one hand it has a perceptibly better acoustic quality by comparison with excellent soundboards of traditional construction, and in particular whilst retaining the usual and desired timbre of a solid wood soundboard it has a substantially higher radiated power, but on the other hand it is distinguished by a simplified production by comparison with known sound boards of composite fibre material construction.

In a soundboard of the type set out in the introduction this object is achieved according to the invention in that the long fibres of the two outer sheets are disposed parallel to one another in the respective sheet and—relative to an imaginary vertical longitudinal central plane of the soundboard—extend at acute angles between 2 and 25°, preferably between 3 and 8°.

In detail, the invention is based on the following considerations and tests:

The cause of the sound radiation of the instrument is the characteristic vibrations. The frequencies and vibrational shapes thereof crucially determine the timbre of the instrument. The formation of the characteristic vibrations depends basically upon the anisotropy of the material of the soundboard, that is to say upon the directionality of its physical properties. Thus the anisotropy of the velocity of sound of the longitudinal waves, i.e. the ratio of velocity of sound in the longitudinal direction to velocity of sound in the cross direction of the run of the fibres, is approximately 4:1 in the case of spruce wood. Therefore in order to achieve the same timbre in a soundboard of composite fibre material construction as in a good wood soundboard it is a matter of achieving the said anisotropy.

Attempts have been made to produce the required anisotropy by positioning a plurality of unidirectional layered fibre structures at specific angles crosswise one above the other on both sides of the core plate. In this case the angles which the longitudinal fibre directions of the various layered fibre structures assume relative to one another determine the ratio of longitudinal stiffness to cross stiffness.

However, these conventional approaches to a solution underestimate an acoustically significant property of soundboards. The vibration levels of the characteristic vibrations are crucial for the sound radiation of the instrument. They are dependent upon the vibrating mass of the soundboard which should be as small as possible if an effective sound radiation is to be achieved. Since in the case of composite fibre sandwich constructions the predominant proportion of the total mass is provided not by the core plate but by the fibre laminate, the total mass depends above all on the number of composite fibre laminates which is necessary. It can be shown that already when only two unidirectional fibre laminates are used per core plate side no acoustic advantages are achieved any longer over the conventional spruce soundboard.

The construction according to EP 1 119 532 A solves the problem set out above in that the fibre laminate provided on one or both sides of the core plate is single-layer and at the same time multidirectional. The desired low mass is achieved by the single-layer construction of the fibre laminate and the individual regions of the soundboard have the desired ratio of longitudinal stiffness to cross stiffness due to the multidirectional fibre laminate.

The solution according to the present invention goes a considerable step beyond the earlier proposal described above. It is based upon the knowledge that—contrary to the previous opinion of the specialists—it is entirely possible using one single long fibre sheet (with long fibres disposed parallel to one another within the sheet) to achieve the desired anisotropy of the velocity of sound of the longitudinal waves when the fibres of the two sheets extend at acute angles (relative to an imaginary vertical longitudinal central plane of the soundboard). In this case the single-layer construction of the two sheets makes possible the low mass of the soundboard which is necessary in order to achieve the desired high sound radiation.

Figure 7A:
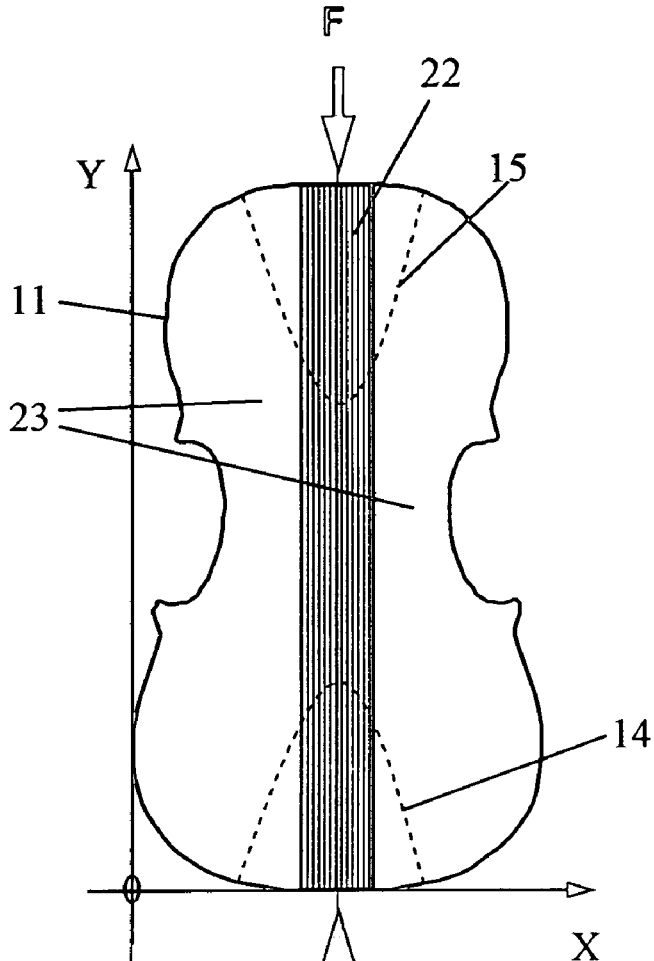

Advantageous embodiments of the invention are the subject matter of the subordinate claims and are explained in greater detail in connection with the description of some embodiments which are illustrated in the drawings wherein:

FIGS. 1–6 are diagrammatic, exploded, elevational views illustrating a soundboard formed of three separate sheets which, when assembled, are in sandwich form:

FIG. 7*a* is an elevational view of a core plate of a soundboard; and

Figure 7B:
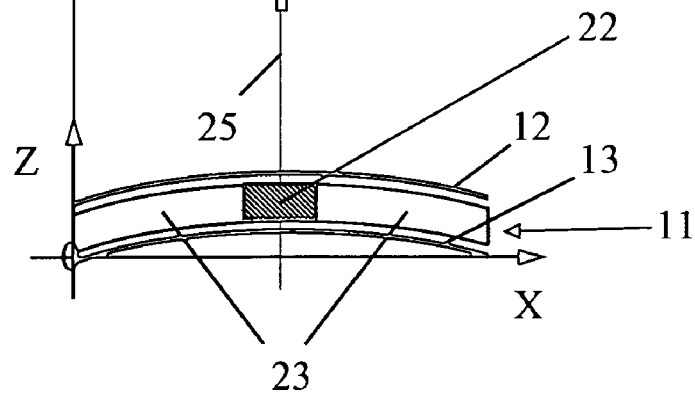

FIG. 7*b* is a transverse sectional view of a soundboard incorporating the core plate of FIG. 7*a*.

FIG. 1 shows a first embodiment of a soundboard according to the invention in a schematic exploded representation of the three sheets 1, 2 and 3 thereof. The middle sheet 1 which forms a core plate has a lower density than the two outer sheets 2 and 3. It can be made from wood or hard foam and can contain long fibres which extend parallel to an imaginary vertical longitudinal central plane 4 of the soundboard.

The two outer sheets 2 and 3 each contain a layer of long fibres which are embedded in a carrier material (e.g. epoxy resin) and extend parallel to one another within the respective sheet. With the imaginary vertical longitudinal central plane 4 of the soundboard the long fibres of the sheets 2 and 3 form opposing angles 5 and 6 respectively of different sizes: the long fibres of the upper sheet 2 are offset anticlockwise and the long fibres of the lower sheet 3 are offset clockwise relative to the vertical longitudinal central plane 4.

If one imagines a horizontal longitudinal central plane of the soundboard (that is to say in the case of a symmetrical construction of the soundboard approximately the horizontal central plane of the middle sheet 1), then the two outer sheets 2 and 3 lie respectively above and below this imaginary horizontal longitudinal central plane, with their long fibres extending at different angles 5 and 6 respectively—relative to the imaginary vertical longitudinal central plane 4 of the soundboard.

Figure 2:
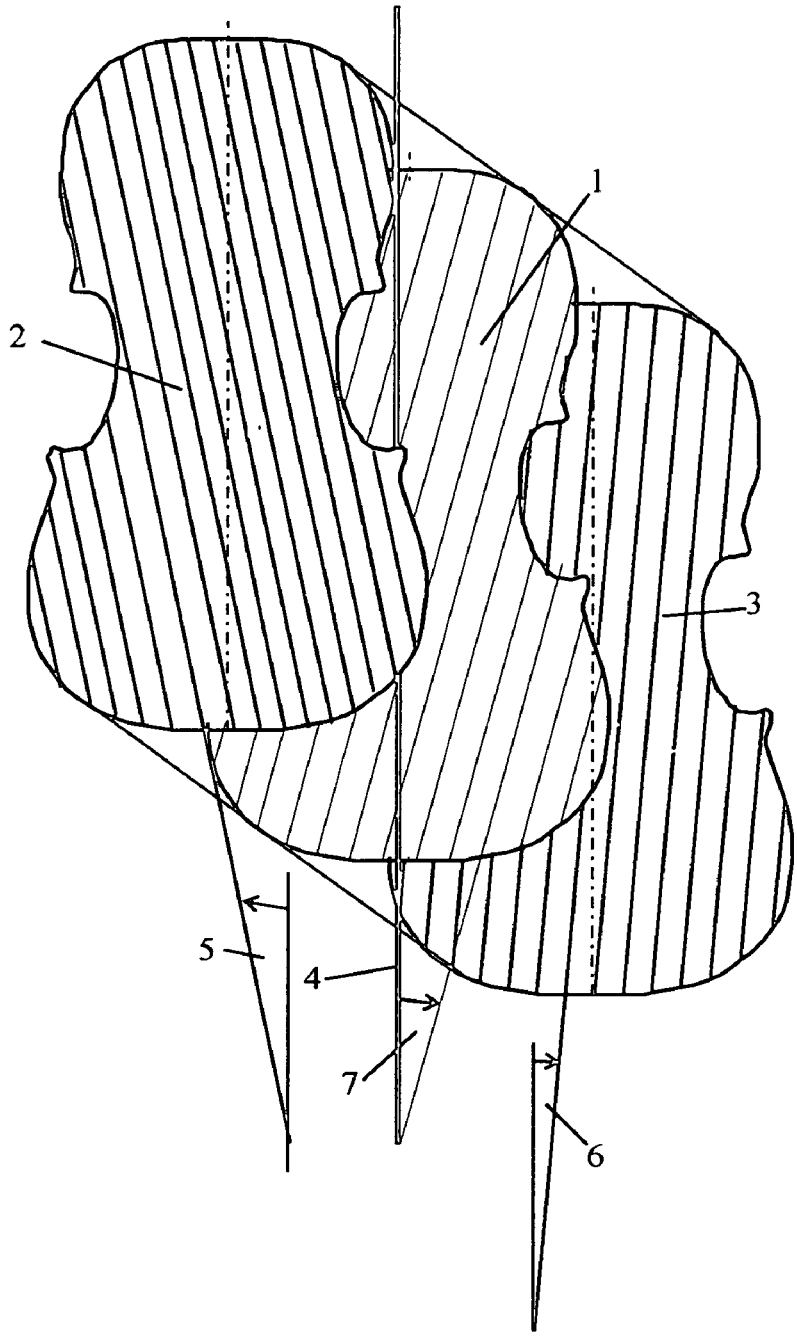

Also in the embodiment according to FIG. 2 the long fibres of the two outer sheets 2 and 3 are embedded in a carrier material and extend at opposing angles 5 and 6 respectively of different sizes (relative to the vertical longitudinal central plane 4 of the soundboard). In contrast to the embodiment according to FIG. 1, in the soundboard according to FIG. 2 the long fibres of the middle sheet 1 do not extend parallel to the vertical longitudinal central plane 4 but are rotated by an angle 7 clockwise relative to this plane.

Figure 3:
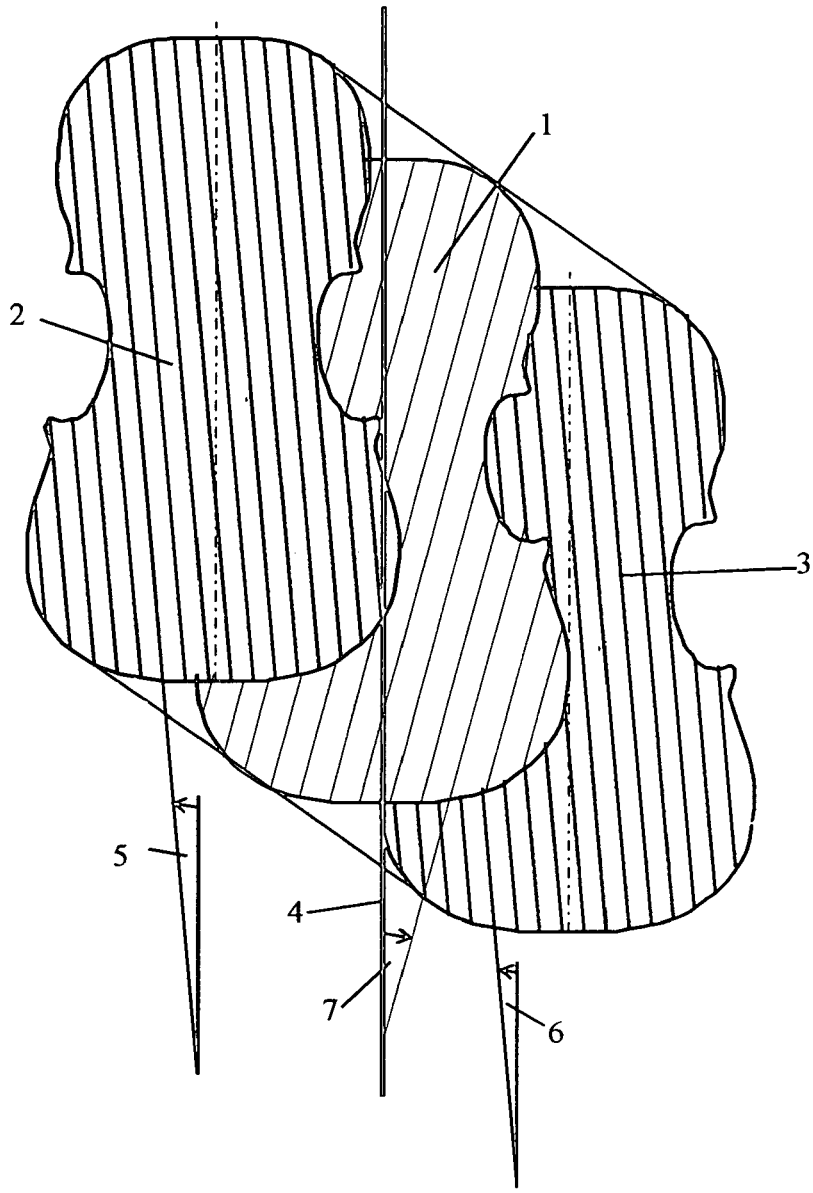

In the variant illustrated in FIG. 3 the long fibres of the two outer sheets 2 and 3 extend at angles 5 and 6 respectively which are both rotated anticlockwise relative to the vertical longitudinal central plane 4 and only differ slightly in size, whilst the long fibres of the middle sheet 1 are offset by an angle 7 in the clockwise direction relative to the plane 4. If one imagines a horizontal longitudinal central plane through the soundboard (which in the case of a symmetrical construction of the three sheets coincides with the horizontal central plane of the middle sheet), then the long fibres of the upper sheet 2 extend at a different angle from the long fibres in the region of the middle sheet (angle 7) lying below the imaginary horizontal longitudinal central plane. A corresponding consideration applies to the lie of the long fibres in the lower sheet 3 (angle 6) and the long fibres in the region of the middle sheet 1 (angle 7) lying above the imaginary horizontal longitudinal central plane.

Figure 4:
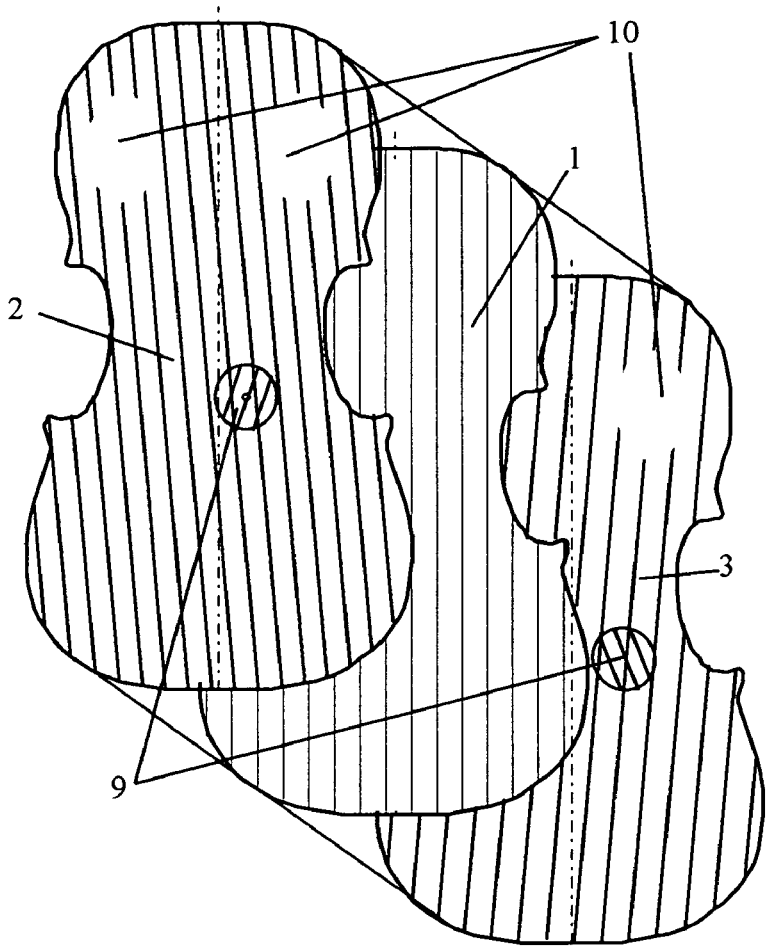

The embodiment according to FIG. 4 has two special features by comparison with the variant according to FIG. 1: The part-region of the soundboard which is intended for support of a soundpost and for this reason is subjected to an elevated compressive load, is reinforced by an additional layer 9 of fibres embedded in a carrier material. The layers 9 are advantageously applied to the underside of the upper sheet 2 and to the underside of the lower sheet 3 (facing the soundpost). The fibre direction of the layers 9 is in each case contrary to the fibre direction of the sheets 2 and 3.

The second special feature of the construction according to claim 4 resides in the fact that part-regions 10 above and below the middle sheet which forms the core plate do not have any fibre laminate. However, the sheets 2 and 3 made from long fibres and carrier material extend over a substantial part of the entire surface of the soundboard.

Figure 5:
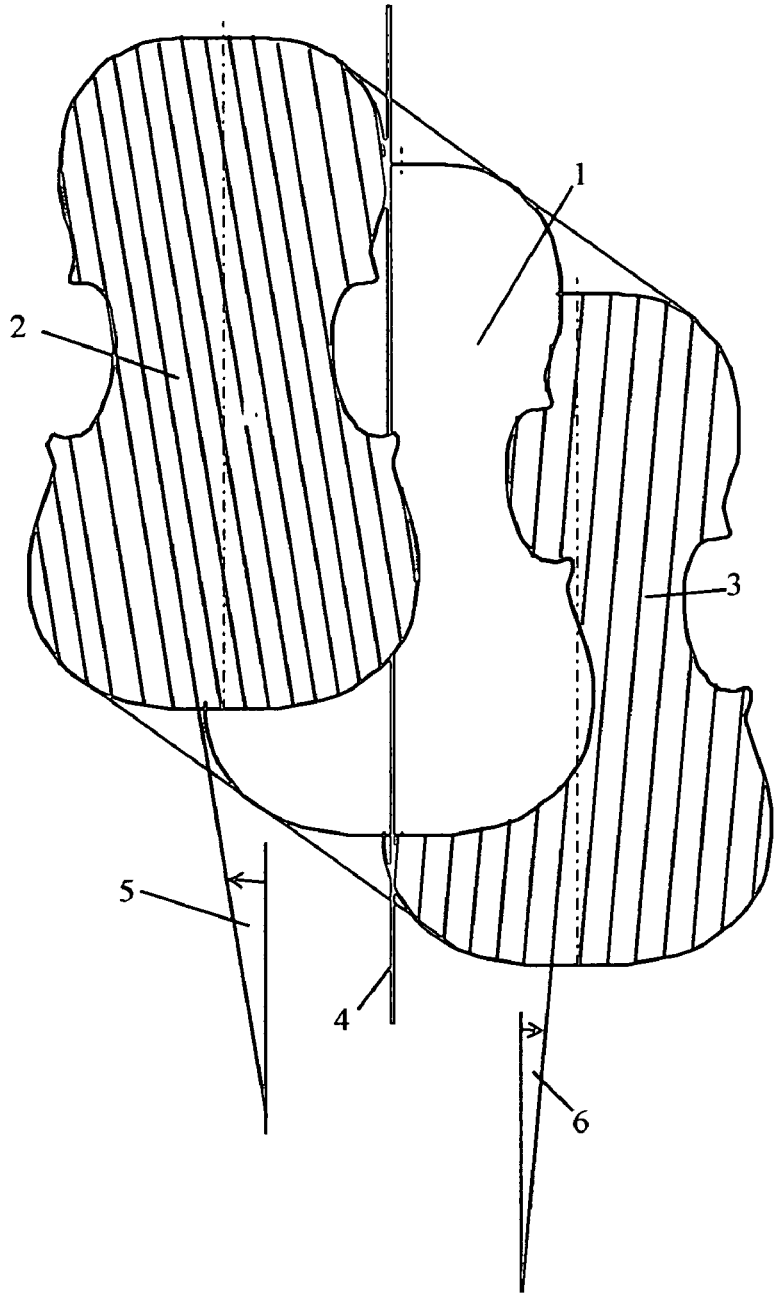

In the embodiment of the invention illustrated in FIG. 5 the middle sheet 1 is constructed as a core plate which is not reinforced by long fibres. In this case the long fibres in the two outer sheets 2 and 3 extend (as in the variant according to FIG. 1) at angles 5 and 6 respectively of different sizes which are rotated in opposite directions relative to the longitudinal central plane 4.

Figure 6:
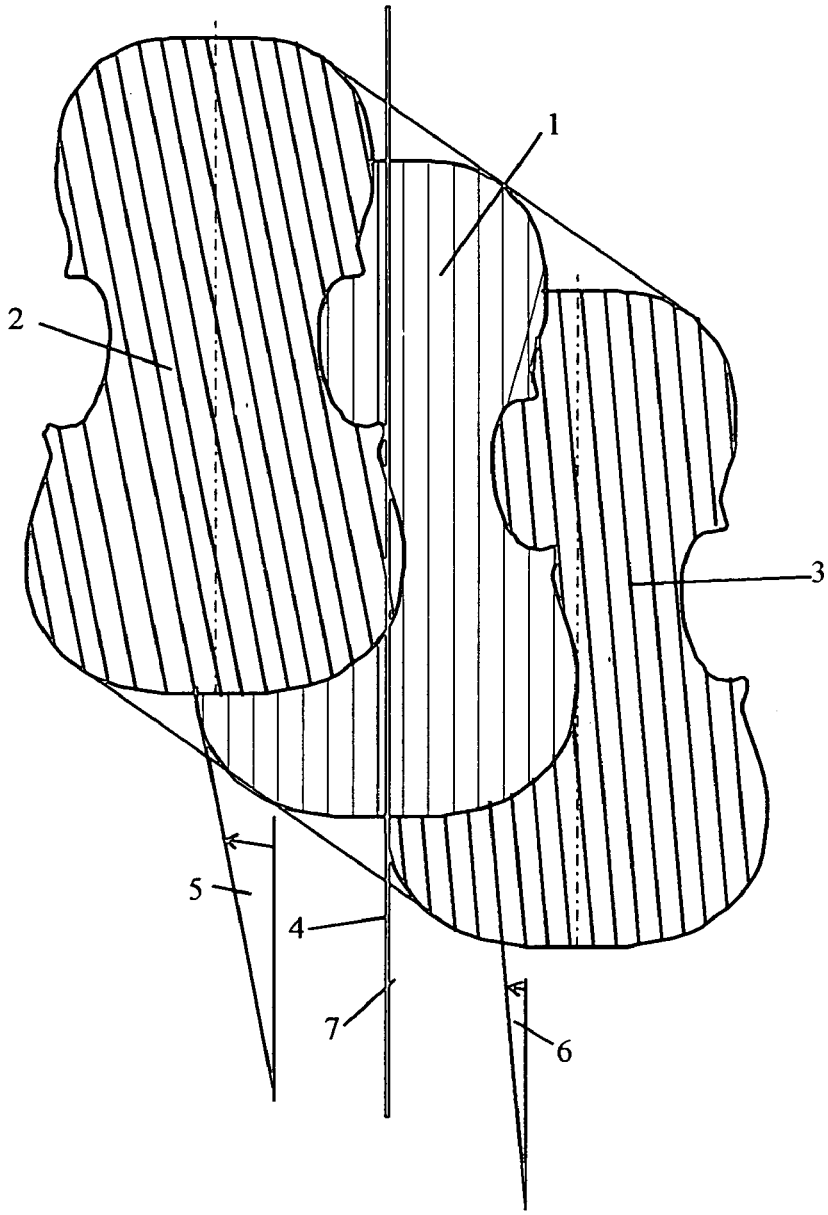

Finally, FIG. 6 shows an embodiment in which the long fibres embedded in a carrier material of the two outer sheets 2 and 3 are offset in the same direction but at different angles 5 and 6 respectively relative to the vertical longitudinal central plane 4 of the soundboard. The middle sheet 1 contains long fibres which extend parallel to the longitudinal central plane 4. Instead of this, however, a middle sheet 1 without long fibres can also be used.

In constructions according to FIGS. 1, 4 and 5 in which the long fibres of the two outer sheets extend at opposing angles, these angles can lie between 2 and 25°, preferably between 3 and 8°.

In a construction according to FIG. 3, in which the long fibres of the two outer sheets are offset in one direction and long fibres of the middle sheet are offset in the other direction relative to the vertical longitudinal central plane, the angle of the two outer sheets in the same direction can be between 2 and 25°, preferably between 3 and 8°, and the opposing angle of the middle layer can be 1.2 to 2.5 times the value of the first-mentioned angle.

Finally, yet another advantageous embodiment of the invention is explained with the aid of FIGS. 7*a* and 7*b*. It relates to a measure which first and foremost concerns the stability of the soundboard, but also has an influence on the anisotropy of the velocity of sound of the longitudinal waves and for this reason is also advantageously taken into consideration in the choice of the angles of the long fibres.

In the embodiment illustrated in FIGS. 7*a*, 7*b* the soundboard comprises a core plate 11 and two outer sheets 12, 13. As is explained with the aid of FIGS. 1 to 6, these two outer sheets each contain a layer of long fibres embedded in a carrier material, whereby in each sheet the long fibres extend parallel to one another in case, whilst the long fibres of the two sheets have different angles.

In this embodiment the core plate 11 is constructed in such a way that it has central zone of elevated longitudinal compression strength which includes the vertical longitudinal central plane 25. In the illustrated embodiment this zone is formed by a strip 22 of high longitudinal compression strength which is preferably made from spruce. Two outer strips 23 which are made from a material of low density (and correspondingly low compression strength), preferably from balsa wood or hard foam, adjoin this central zone laterally.

Due to this construction of the core plate it is ensured that in particular the two end regions 14, 15 of the central zone of the soundboard which must absorb the high compressive forces F, −F generated by the string tension of the instrument have the necessary longitudinal compression strength and cannot buckle under the effect of these forces.

The strip 22 of high longitudinal compression strength advantageously occupies a width of 10 to 25%, preferably 14 to 20%, of the total width of the outline of the soundboard. Depending upon the chosen dimensions and strength characteristics of the strips 22, 23 the result is a different contribution of the core plate 11 to the anisotropy of the soundboard. This contribution should be taken into consideration when the angles of the long fibres of the outer sheets 12, 13 are chosen for the purpose of setting the desired anisotropy.

I claim:

1. In a soundboard of composite fibre material for use as a soundboard of a resonate body of a stringed musical instrument, said soundboard having at least three sheets each of which constitutes a substantial part of a surface of said soundboard and one of which sheets lies between the other two sheets, each of said other two sheets having a layer of long fibres embedded in a carrier material, said one of said sheets having a density lower than that of each of said other two sheets, the improvement wherein said long fibres of each respective sheet of said other two sheets are parallel to one another and extend at an acute angle of between about 2° and 25° relative to an imaginary vertical longitudinal central plane of said soundboard.

2. The soundboard according to claim 1 wherein said acute angles are between about 3° and 8°.

3. The soundboard according to claim 1 wherein the long fibres of each of said other two sheets extend at opposing acute angles relative to said imaginary plane.

4. The soundboard according to claim 1 wherein the long fibres of said other sheets extend generally in the same direction but at different angles relative to said imaginary plane.

5. The soundboard according to claim 1 wherein said one of said sheets comprises a core plate which does not include a layer of said long fibres embedded in a carrier material.

6. The soundboard according to claim 1 wherein said one of said sheets includes a layer of long fibres embedded in a carrier material.

7. The soundboard according to claim 6 wherein the long fibres of said one of said sheets extend at an angle relative to said imaginary plane which is between the acute angles at which the long fibres of said other sheets extend.

8. The soundboard according to claim 7 wherein the long fibres of said other two sheets extend relative to said imaginary plane at acute angles of different sizes and wherein the long fibres of said one of said sheets extend relative to said imaginary plane at an angle which is in the same general direction as the smaller of said two acute angles.

9. The soundboard according to claim 7 wherein said long fibres of said other two sheets extend relative to said imaginary plane at angles generally in the same direction and the long fibres of said one of said sheets extend relative to said imaginary plane at an opposing angle.

10. The soundboard according to claim 7 wherein the long fibres of said one of said sheets extends substantially parallel to said imaginary plane.

11. The soundboard according to claim 1 wherein selected regions of said soundboard intended for support of a soundpost are reinforced by an additional layer of fibres embedded in a carrier material.

12. The soundboard according to claim 1 wherein two end regions of a central zone of said soundboard have a longitudinal compression strength greater than that of the remainder of said soundboard.

13. The soundboard according to claim 12 wherein said remainder of said soundboard includes two outer zones adjoining said central zone.

N

* * * * *